US005090059A

United States Patent [19]

Kahl

[11] Patent Number: 5,090,059

[45] Date of Patent: Feb. 25, 1992

[54] MOTHER'S NURSING COVER

[76] Inventor: Cindy L. Kahl, 4201 Horry St., Apt. B-6, Columbia, S.C. 29203

[21] Appl. No.: 656,830

[22] Filed: Feb. 19, 1991

[51] Int. Cl.[5] ..... A41D 1/20

[52] U.S. Cl. ..... 2/104; 2/46

[58] Field of Search ..... 2/46, 48, 49 R, 49 A, 2/50, 51, 88, 104, 273; 450/36

[56] References Cited

U.S. PATENT DOCUMENTS

| | | | |
|---|---|---|---|
| 1,003,489 | 9/1911 | Moritz | 2/50 |
| 1,388,802 | 8/1921 | Cooper | 2/273 |
| 1,497,756 | 6/1924 | Jones | 2/49 R |
| 1,598,838 | 9/1926 | Wilcott | 2/50 |
| 1,963,130 | 6/1934 | Hall | 2/49 R |
| 2,567,524 | 9/1951 | Morganti | 2/49 R |
| 4,004,294 | 1/1977 | Pinch | 2/104 |
| 4,106,122 | 8/1978 | Dodd | 2/104 |
| 4,139,912 | 2/1979 | Thuaud | 2/50 |
| 4,144,593 | 3/1979 | Timmons | 2/104 |
| 4,601,068 | 7/1986 | Frechette | 2/104 |
| 4,651,349 | 3/1987 | Heiler | 2/104 |
| 4,663,782 | 5/1987 | Knox et al. | 2/104 |
| 4,995,116 | 2/1991 | Beauchamp et al. | 2/104 |

FOREIGN PATENT DOCUMENTS

| | | | |
|---|---|---|---|
| 693521 | 11/1930 | France | 2/51 |

*Primary Examiner*—Werner H. Schroeder
*Assistant Examiner*—Jeanette E. Chapman

[57] ABSTRACT

A concealment covering for the upper frontal areas of a woman's torso during a baby nursing procedure. The covering includes a neck strap and shoulder-engagement sections for holding the covering in place. Slit openings are formed in the covering sheet for enabling the mother to reach into the space behind the sheet to hold the baby. A relatively large sight opening is provided in an upper portion of the sheet to enable the mother to see the baby's head during the nursing process.

1 Claim, 1 Drawing Sheet

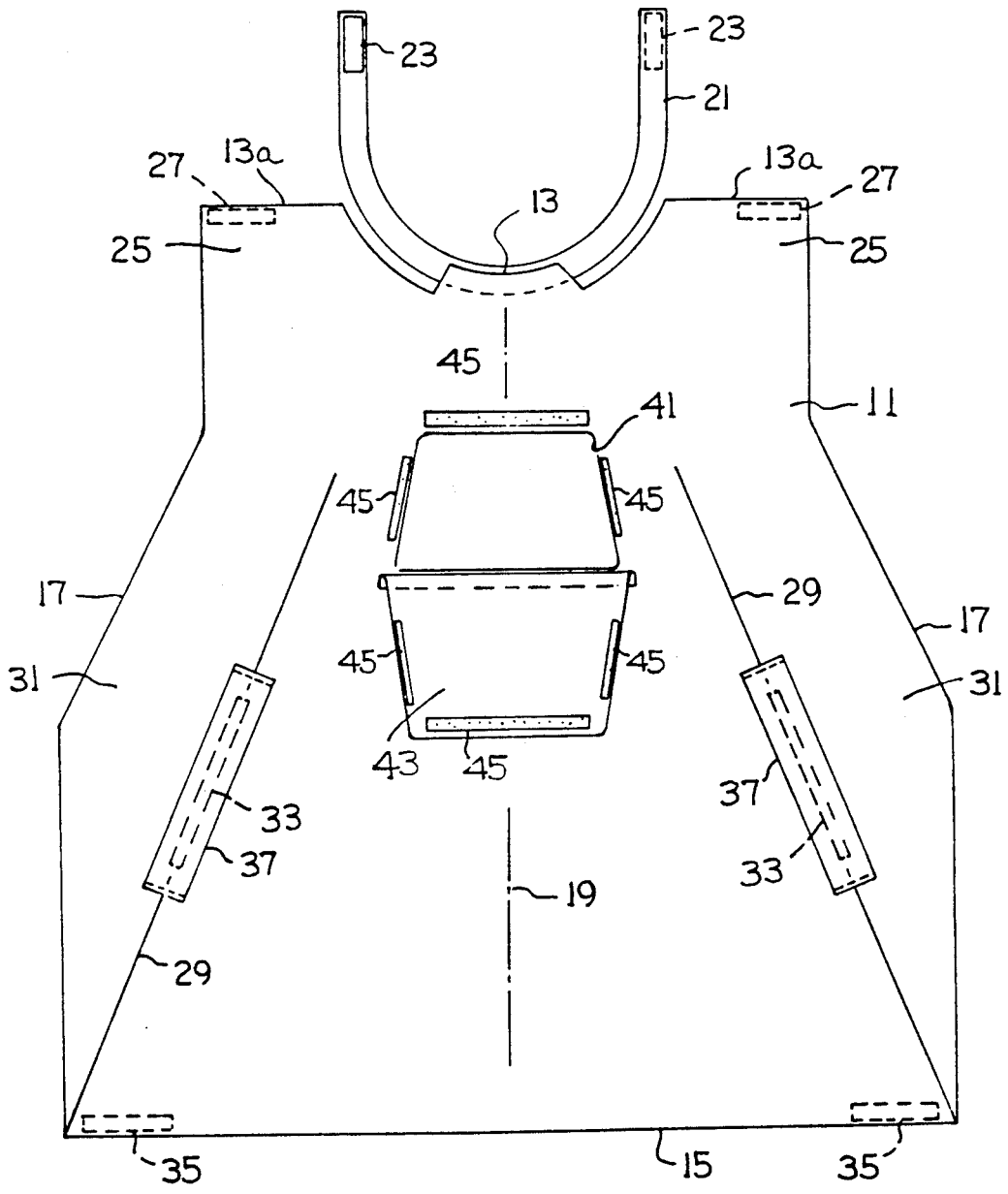
23
23
21
27
13a
13a
27
13
25
25
45
41
11
45
45
17
29
17
45
45
31
31
43
45
37
33
37
33
19
29
35
15
35

MOTHER'S NURSING COVER

BACKGROUND AND SUMMARY OF THE INVENTION

This invention relates to the nursing of infants (babies), and particularly to a detachable covering sheet that a mother can drape over her upper frontal area to shield her breasts from view while she is nursing a baby.

U.S. Pat. No. 4,144,593 to S. Timmons discloses various items of clothing (e.g. a dress, nightgown or blouse) having one or more panels attached to the front of the garment to provide a shield over the breast area of the garment. The panel is sewn or otherwise hingedly attached to the garment on a line slightly below the garment shoulders, with the panel side edges and panel lower edge being completely detachable (severable) from the garment. When a mother desires to nurse her baby she pulls the lower portion of the panel forwardly away from the garment to provide a concealed space between the rear face of the panel and her breasts. The mother holds the baby in this concealed space during the nursing process. The panel conceals the baby and the mother's breast area from view, thereby preventing possible embarrassment to the mother or other people in the area.

There are some disadvantages with the panel arrangement shown in U.S. Pat. No. 4,144,593. For example, the panel completely conceals the baby from the mother's view, such that the mother may not always be fully certain that the nursing action is going ahead satisfactorily. Also, the baby cannot see the mother and may become afraid due to the close confinement of the panel over (around) the baby's face. An additional potential problem is that the panel prevents ventilation air from circulating around the baby's face. Confined air within the concealed space may not have the desired freshness or breathability.

Additional problems relate to the fact that the add-on panel adds to the cost of each garment on which it is used; each garment has to be equipped with its own panel, with some cost duplication. Also, the add-on panel can only be cleaned by cleaning the entire garment.

The present invention contemplates a detachable covering that is entirely separate from any garment worn by the mother. The covering comprises a flexible fabric sheet having a neck strap connected to its upper edge, whereby the sheet can be suspended in front of the mother's torso to conceal the baby and the mother's breast area during the breast-feeding (nursing) operation. The mother's blouse or dress can be unbuttoned, with the fabric sheet acting as an opaque screen. When the nursing operation is completed the fabric sheet can be completely removed and stored until it again is needed.

The flexible fabric sheet has a relatively large sight opening located a slight distance below the neck strap, i.e. in front of the mother's upper chest area. The mother can look down through the sight opening and see the baby's head. Also, the baby can look up or out, to see the mother or ambient scenery. The sight opening also provides a ventilation function, to prevent trappage of air within the space behind the fabric sheet.

Two laterally-spaced slit openings are formed in the sheet below the sight opening. Each slit opening is relatively long, e.g. about five or six inches, such that the mother can pass either hand therethrough to hold the baby. The sheet can be in a relatively unwrinkled condition draped over the mother's frontal area, while the mother's hands extend through the slit openings to hold and move the baby in an essentially unrestrained fashion.

THE DRAWINGS

The single figure is a plan view of a detachable covering embodying features of the invention.

DESCRIPTION OF A PREFERRED EMBODIMENT OF THE INVENTION

The drawing shows a detachable covering that includes a flexible fabric sheet 11, preferably formed of an opaque woven cloth material that has a high degree of flexibility so that it can be draped over the upper frontal area of a mother's torso while she is nursing her infant. Sheet 11 has an upper edge 13, lower edge 15, and two side edges 17. The drawing shows an imaginary central vertical axis 19 extending midway between the two side edges of the sheet.

A flexible neck strap 21 is attached to the upper edge 13 of the sheet at a central point therealong, i.e. in the vicinity of vertical axis 19. Mating patches 23 formed of hook and loop pile material are carried on the free ends of the strap. The patch materials are preferably adherent materials marketed under the tradename VELCRO. When the neck strap is extended around the mother's neck the two patches will adhere together to retain the strap against inadvertant disengagement.

Upper sections 25 of sheet 11 are spaced laterally from vertical axis 19 alongside strap 21 so as to extend over the mother's shoulders when strap 21 is extended and fastened around her neck. Edge areas **13*a* will be located behind the mother's shoulder blades. Weights 27** are sewn into the fabric to help retain the fabric sheet against slippage off the mother's shoulders.

Two laterally spaced dart seams 29 are sewn into the fabric sheet. Each dart seam extends downwardly and away from imaginary axis 19 such that the two seams are downwardly divergent relative to each other. Prior to the seams being sewn, two triangular sections are cut out from the fabric sheet; the edges of each triangular cutout form one of the seams. In this way the outboard sections 31 of the sheet angle rearwardly away from the plane of the paper so as to better fit around side areas of the mother's torso. During a nursing procedure the baby is located behind the fabric sheet against the mother's clothing. The fabric sheet is only worn during the nursing operation; at other times it is removed and stored.

Slit openings 33 are formed in the fabric sheet at points spaced equidistant from the sheet vertical axis 19. Each slit opening preferably has a length of at least about five inches, such that the mother can extend a hand through either opening to directly touch and hold the baby, either behind the baby's neck or around the baby's legs. The vertical length of sheet 11 is preferably at least about two and one half feet, such that the lower edge 15 of the sheet is approximately at waist level. Slit openings 33 enable the mother to reach into the space behind sheet 11 without having to lift or otherwise disturb the lower edge area of the sheet. Weights 35 may be sewn into the sheet at its lower corners to assist in keeping the sheet against the mother's body.

In order to conceal the slit openings 33 from view a shield strip 37 is sewn onto sheet 11 so as to overlie each slit opening. Each shield strip is sewn to sheet 11 only along its upper and lower ends, leaving the longitudinal side edges unconnected or optionally sewn on medial longitudinal side edge. The mother's hand can be extended underneath each strip 37 into the associated slit opening.

As an important feature of the invention, a sight opening 41 is formed through sheet 11 at a central point a slight distance below neck strap 21. When the neck strap is extended around the mother's neck, opening 41 is centrally located on the upper chest area of the mother's torso. The mother can look downwardly through opening 41 to see the baby's head. She can thus better hold the baby in proper position. Also, the baby can have eye contact with the mother for reassurance of the mother's presence. Opening 41 also provides for ventilation of the space behind sheet 11. A flap type closure 43 may be hingedly attached to sheet 11 along the lower edge of opening 41. Patches 45 of adherent material, e.g. materials sold under the name VELCRO, may be carried on the closure and on sheet 11 to retain the closure in a closed position. The closure is an optional feature; sight opening 41 can be used without the closure. Opening 41 is considered to be an essential feature of the invention. The sight opening should be of relatively large area, e.g. at least five square inches. The upper limit on the area is dictated primarily by the overall purpose of the covering, i.e. to shield the mother's breast area from view during the nursing operation. Opening 41 is centrally located so that the mother can see the baby's head whichever breast is being used for feeding the baby.

What is claimed is:

1. A detachable covering for a mother while nursing a baby; said covering comprising a flexible fabric sheet having an upper edge, two side edges, and a lower edge; said fabric sheet having an imaginary vertical axis (19) extending midway between said side edges; a neck strap attached to the upper edge of said fabric sheet at a central point therealong; a two dimensional sight opening in said sheet directly below the neck strap attachment point, whereby the mother can look downwardly through the sight opening to view the baby carried against the mother's body behind the fabric sheet; said sight opening being centrally located in an upper portion of the sheet for disposition on the upper chest area of the mother; said sight opening having an area of at least five square inches for ensuring adequate ventilation of the area behind the fabric sheet, and for enabling the mother to obtain an adequate view of the baby; said fabric sheet having two laterally spaced dart seams (29) diverging downwardly and away from the sheet vertical axis, said dart seams extending from points along side said sight opening to the lower edge of the fabric sheet, whereby areas of the sheet adjacent the sheet side edges tend to wrap around the mother's torso underneath the arm pit areas; and a slit opening (33) extending along each dart seam at an intermediate point therealong, each slit opening having a sufficient length that the mother can pass either hand therethrough to directly hold the baby behind the fabric sheet in a nursing position.

* * * * *